US007784447B2

(12) United States Patent
Ricco et al.

(10) Patent No.: US 7,784,447 B2
(45) Date of Patent: Aug. 31, 2010

(54) FUEL INJECTION SYSTEM COMPRISING A HIGH-PRESSURE VARIABLE-DELIVERY PUMP

(75) Inventors: Mario Ricco, Valenzano (IT); Sisto Luigi De Matthaeis, Valenzano (IT); Onofrio De Michele, Valenzano (IT); Annunziata Anna Satriano, Valenzano (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 329 days.

(21) Appl. No.: 11/108,201

(22) Filed: Apr. 18, 2005

(65) Prior Publication Data

US 2006/0137657 A1 Jun. 29, 2006

(30) Foreign Application Priority Data

Dec. 23, 2004 (EP) ..... 04425944

(51) Int. Cl.
*F02M 37/00* (2006.01)

(52) U.S. Cl. ..... 123/510

(58) Field of Classification Search ..... 123/446, 123/467, 456, 514, 500, 501, 179.17, 499, 123/496, 495, 503, 506–508, 510, 511, 447; 417/493, 494, 496; 701/103; *F02M 37/00*
See application file for complete search history.

(56) References Cited

U.S. PATENT DOCUMENTS 4,095,940 A 6/1978 Weingarten
4,884,545 A * 12/1989 Mathis ..... 123/447
5,622,152 A * 4/1997 Ishida ..... 123/446
5,798,304 A 8/1998 Clarkson
5,884,606 A * 3/1999 Kellner et al. ..... 123/446
6,293,253 B1 * 9/2001 Arnold et al. ..... 123/458
6,367,452 B1 4/2002 Shima et al.
6,581,577 B1 * 6/2003 Geyer ..... 123/514
6,659,085 B2 12/2003 Kojima
6,889,656 B1 * 5/2005 Rembold et al. ..... 123/446
2001/0022171 A1 * 9/2001 Gaessler et al. ..... 123/446

(Continued)

FOREIGN PATENT DOCUMENTS

DE 199 56 093 5/2001

(Continued)

OTHER PUBLICATIONS

Dyeing Primer a Series of Short Papers on the Fundamentals of Dyeing and reprinted from Textile Chemist and Colorist by the American.

(Continued)

*Primary Examiner*—Stephen K Cronin
*Assistant Examiner*—Keith Coleman
(74) *Attorney, Agent, or Firm*—Ladas and Parry LLP

(57) ABSTRACT

The injection system has a high-pressure pump (7) having at least one pumping element (18) operated reciprocatingly to perform an intake stroke and a delivery stroke. Each pumping element (18) has a corresponding intake valve (25) communicating with an intake conduit (10) supplied by a low-pressure pump (9). The intake conduit (10) is fitted with an on-off solenoid valve (27) controlled by a control unit (16) asynchronously with respect to the intake of each pumping element (18). And the control unit (16) may control the on-off solenoid valve (27) by means of frequency-modulated and/or duty-cycle-modulated control signals (A, C).

10 Claims, 3 Drawing Sheets

U.S. PATENT DOCUMENTS

| | | | | |
|---|---|---|---|---|
| 2003/0034010 | A1* | 2/2003 | Kellner et al. | 123/446 |
| 2003/0213471 | A1* | 11/2003 | Kieferle et al. | 123/447 |
| 2004/0016830 | A1 | 1/2004 | Boos et al. | |
| 2004/0089268 | A1* | 5/2004 | Brenk et al. | 123/446 |
| 2005/0241616 | A1* | 11/2005 | Holl et al. | 123/446 |

FOREIGN PATENT DOCUMENTS

| | | |
|---|---|---|
| EP | 1 249 599 | 10/2002 |
| EP | 1 306 553 | 5/2003 |
| JP | 01-301953 | 12/1989 |
| JP | 11-037012 | 2/1999 |
| JP | 2000-227172 | 8/2000 |
| JP | 2000-282929 | 10/2000 |
| JP | 2002-021684 | 1/2002 |
| JP | 2002-309988 | 10/2002 |
| JP | 2003-515701 | 5/2003 |
| JP | 2004-011448 | 1/2004 |
| WO | 01/40656 A1 | 6/2001 |

OTHER PUBLICATIONS

Association of Textile Chemists and Colorists, Research Triangle Park, North Carolina, Copyright 1981.

* cited by examiner

FUEL INJECTION SYSTEM COMPRISING A HIGH-PRESSURE VARIABLE-DELIVERY PUMP

The present invention relates to an internal combustion engine fuel injection system comprising a high-pressure variable-delivery pump.

As is known, in modern internal combustion engines, the injection system high-pressure pump supplies fuel to a common rail having a given pressurized-fuel storage volume and for supplying a number of engine cylinder injectors. For it to be atomized properly, the fuel must be brought to extremely high pressure, in the region of 1600 bars in maximum engine power conditions. The fuel pressure required in the storage volume of systems of this kind is normally defined by an electronic control unit as a function of the operating conditions of the engine.

Injection systems are known in which a bypass solenoid valve, located along the delivery conduit of the pump, is controlled by the control unit to drain the surplus pumped fuel, in excess of that drawn by the injectors, directly into the fuel tank before it reaches the common rail.

Since delivery of the high-pressure pump normally depends on the rotation speed of the drive shaft, it must be such as to provide the maximum delivery and pressure values required in the various operating conditions of the engine. In certain operating conditions, e.g. at maximum speed but with low power output of the engine, delivery of the pump is excessive, and the surplus fuel is simply drained into the tank. Known regulating devices of this sort therefore have the drawback of dissipating part of the compression work of the high-pressure pump in the form of heat.

Injection systems have been proposed featuring a variable-delivery high-pressure pump to reduce the amount of fuel pumped in low-power engine operating conditions. In one such system, the intake conduit of the pump is fitted with a delivery regulating device comprising a continuously-variable-section constriction controlled by the electronic control unit as a function of the required common rail pressure and/or engine operating conditions.

More specifically, the constriction in the intake conduit is supplied with a constant, roughly 5 bar pressure difference P provided by an auxiliary pump, and continuous variation of the actual flow area modulates intake of the pumping elements connected hydraulically to it. The amount of fuel downstream from the regulating solenoid valve, i.e. the permitted intake, is at very low pressure and, in low delivery conditions, contributes little towards opening the intake valves.

In systems of this type, the usual intake valve return spring must be such as to ensure the valve opens even with a minimum pressure of close to zero downstream from the constriction. On the one hand, the spring must be calibrated extremely accurately, which means the pump is relatively expensive; and, on the other, there is always a risk the intake valve may fail to open on account of the low pressure produced by the pumping element in the relative compression chamber, thus resulting in anomalous operation and severe deterioration of the pump. At the very least, if the pump has a number of pumping elements, it invariably gives rise to asymmetric deliveries.

Another known injection system features a device for regulating fuel supply to the pump and defined by a relatively high-flow on-off solenoid valve located along the intake conduit to supply the pumping member over a variable portion of the intake stroke, the supply cutoff instant of which is modulated.

This regulating device has the drawbacks of having to synchronize operation of the solenoid valve with the position of the pumping element piston during the intake stroke, and of controlling the on-off solenoid valve at high frequency. For example, if the speed of the pump with two 180° pumping elements is 3600 rpm, intake frequency, and therefore the control frequency of the on-off solenoid valve, is 120 Hz.

It is an object of the invention to provide a fuel injection system comprising a high-pressure pump and pump delivery regulating device designed to achieve a highly reliable system of limited cost and involving none of the drawbacks posed by the known state of the art.

According to the present invention, there is provided an internal combustion engine fuel injection system comprising a variable-delivery high-pressure pump and as claimed in claim 1.

More specifically, the on-off solenoid valve has a low flow rate to control metering of the pumped fuel, and communicates with the intake valve of the pumping element via an intake fuel storage volume, so as to supply the pumping element over a variable portion of the intake stroke. A control unit controls the on-off solenoid valve by means of frequency-modulated and/or duty-cycle-modulated control signals. To simplify control, pressure is maintained constant upstream from the on-off valve by means of a pressure regulator, which feeds any surplus fuel into the pump case, thus cooling and lubricating the entire crank mechanism inside the case, and then back into the tank.

A preferred, non-limiting embodiment of the invention will be described by way of example with reference to the accompanying drawings, in which.

Figure 1:
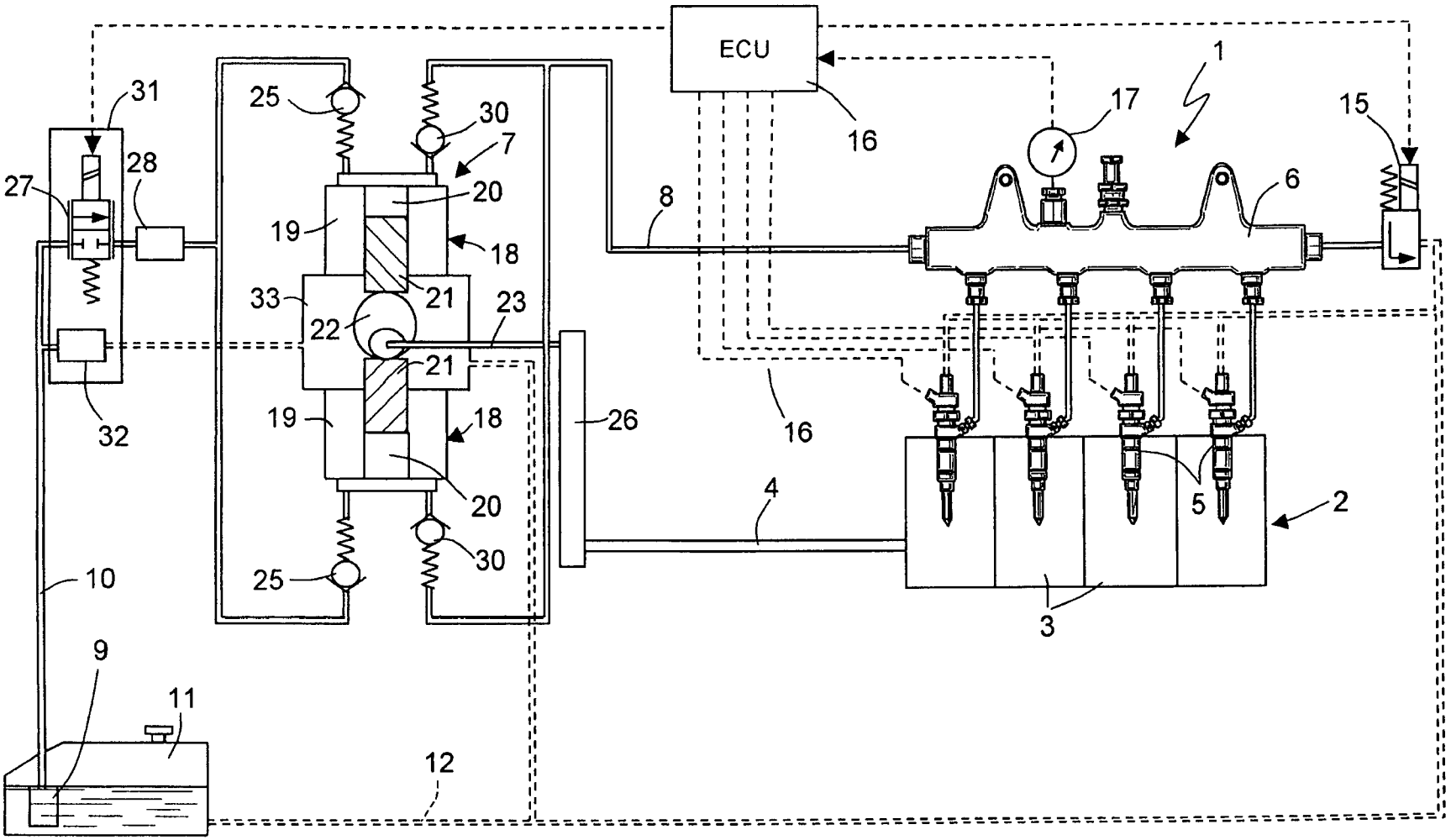
FIG. 1 shows a diagram of an internal combustion engine fuel injection system in accordance with the present invention.

Number 1 in FIG. 1 indicates as a whole a fuel injection system for an internal combustion, e.g. four-stroke diesel, engine 2 comprising a number of, e.g. four, cylinders 3, which cooperate with corresponding pistons (not shown) for rotating a drive shaft 4.

Injection system 1 comprises a number of electrically controlled injectors 5 associated with and for injecting high-pressure fuel into cylinders 3. Injectors 5 are connected to a pressurized-fuel storage volume having a given volume for one or more injectors 5, and which, in the embodiment shown, is defined by a common rail 6, to which injectors 5 are all connected.

Common rail 6 is supplied by a high-pressure pump, indicated as a whole by 7, with high-pressure fuel along a delivery conduit 8; high-pressure pump 7 is in turn supplied by a low-pressure pump, e.g. a motor-driven pump 9, along an intake conduit 10 of pump 7; and motor-driven pump 9 is normally located in the fuel tank 11, to which a surplus-fuel drain conduit 12 of injection system 1 is connected.

Common rail 6 also has a solenoid drain valve 15 communicating with drain conduit 12. A fuel quantity ranging between a minimum and maximum value is injected by each injector 5 into corresponding cylinder 3 under the control of an electronic control unit 16, which may be defined by the central microprocessor control unit of engine 2.

Control unit 16 receives signals, generated by corresponding sensors (not shown), indicating operating conditions of engine 2, such as the accelerator pedal position and the speed of drive shaft 4, and the fuel pressure in common rail 6 as detected by a pressure sensor 17.

Control unit 16 processes the incoming signals by means of a special program to control when and for how long individual injectors 5 are to operate. Control unit 16 also controls opening and closing of solenoid drain valve 15, so that drain conduit 12 feeds into tank 11 the fuel drained by injectors 5, any surplus fuel in common rail 6 drained by solenoid valve 15, and the cooling and lubricating fuel from case 33 of pump 7.

High-pressure pump 7 comprises two pumping elements 18, each defined by a cylinder 19 having a compression chamber 20, in which a piston 21 slides back and forth to perform an intake stroke and a delivery stroke. Each compression chamber 20 has a corresponding intake valve 25 and a corresponding delivery valve 30, both of which may be ball types with respective return springs. Both intake valves 25 communicate with the common intake conduit 10, and both delivery valves 30 communicate with the common delivery conduit 8.

More specifically, piston 21 is operated by a cam 22 fitted to a drive shaft 23 of pump 7. In the FIG. 1 embodiment, both pumping elements 18 are coaxial and opposite, and are operated, with a phase displacement of 180°, by a single cam 22 housed in case 33. Shaft 23 is connected to the drive shaft 4 by a transmission device 26, so that cam 22 commands a compression stroke of one piston 21 for each injection by injectors 5 into respective cylinders 3 of engine 2.

The fuel in tank 11 is at atmospheric pressure. In use, motor-driven pump 9 compresses the fuel to a low pressure, e.g. of around 2-3 bars; and high-pressure pump 7 compresses the incoming fuel from intake conduit 10 to supply high-pressure fuel, e.g. of about 1600 bars, along delivery conduit 8 to pressurized-fuel common rail 6.

According to the invention, the delivery of pump 7 is controlled exclusively by a regulating device 31 along intake conduit 10. The regulating device comprises an on-off solenoid valve 27; and a pressure regulator, shown schematically by 32, for simplifying control of solenoid valve 27. Pressure regulator 32 is located upstream from solenoid valve 27 and provides for maintaining a constant pressure along intake conduit 10. Regulator 32 feeds surplus fuel into case 33 of pump 7 to cool and lubricate the entire operating mechanism inside case 33, from where the surplus fuel is fed back into tank 11 along conduit 12.

The regulating device is operated asynchronously with respect to the intake stroke of pumping elements 18. On-off solenoid valve 27 communicates with intake valves 25 via a storage volume indicated schematically by 28 and for storing the intake fuel of the two pumping elements 18. Intake fuel storage volume 28 is designed to supply each pumping element 18 over a variable portion of the relative intake stroke, depending on the operating conditions of engine 2, and may even be defined by or integrated with the various portions of intake conduit 10 downstream from solenoid valve 27.

Figure 2:
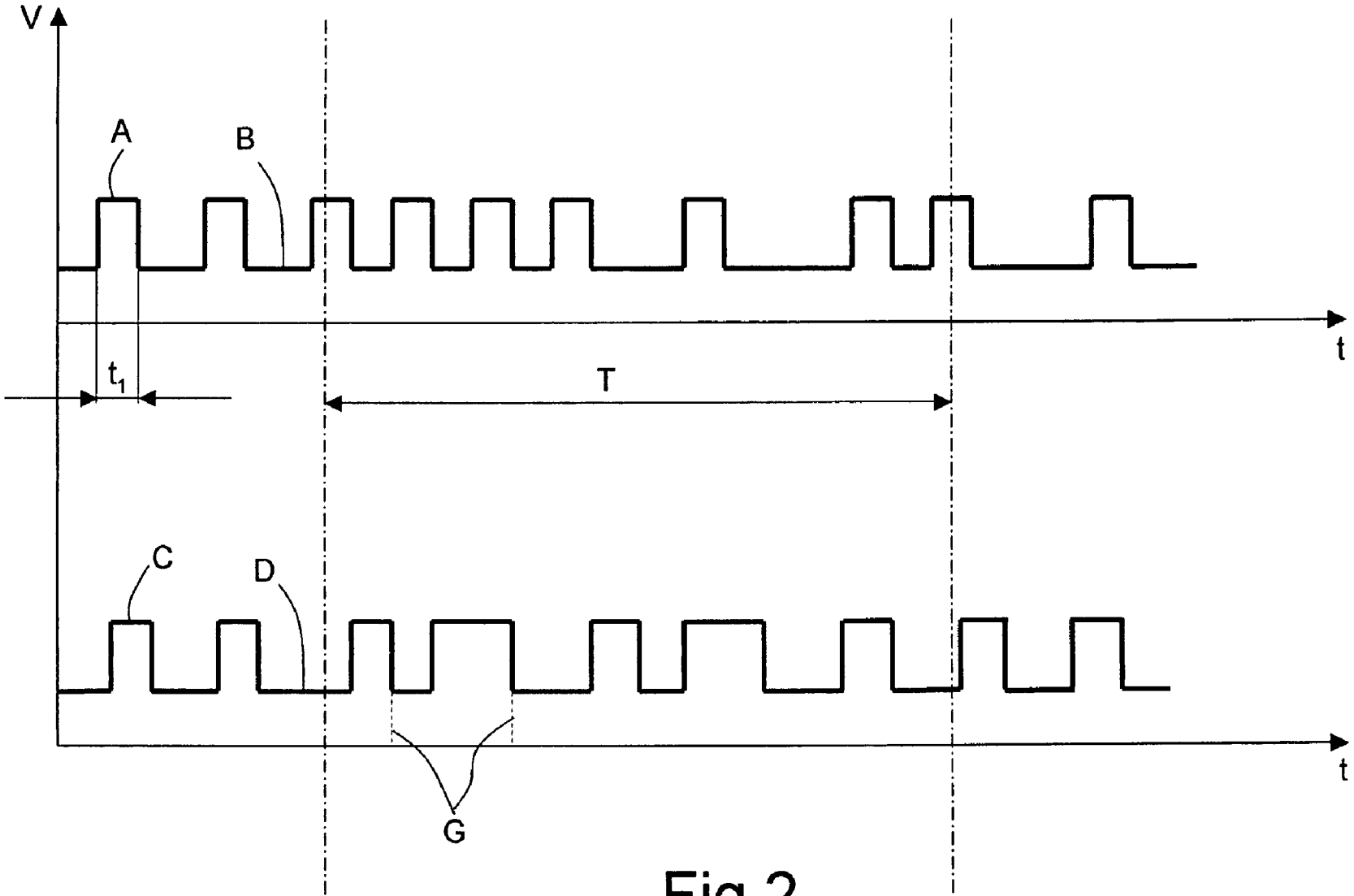
FIG. 2 shows two operating graphs of the FIG. 1 system regulating device.

Solenoid valve 27 is controlled by electronic control unit 16 as a function of the operating conditions of engine 2, which may be determined on the basis of the fuel quantity drawn by pump 7 along conduit 10 and which determines the pressure of the fuel in common rail 6. Solenoid valve 27 is controlled asynchronously with respect to the intake stroke of each pumping element 18, and is controlled by control unit 16 by means of frequency-modulated and/or duty-cycle-modulated control signals. FIG. 2 shows two graphs of two types of control signal. More specifically, the signals may be in the order of a thousandth of a second in duration, and the duty cycle may range between 2% and 95%.

In a first embodiment, control unit 16 controls solenoid valve 27 by means of frequency-modulated control signals A of constant duration t1, so that the amount of fuel to be pumped is varied by varying the time interval B between signals A. In another embodiment, control unit 16 controls solenoid valve 27 by means of duty-cycle-modulated control signals C of constant frequency (PWM, Pulse Width Modulation, strategy). Constant frequency is indicated in FIG. 2 by the constant distance between dash lines G. As such, both the duration of signals C and the interval D between them are varied.

Solenoid valve 27 may obviously be controlled by modulating both the frequency and duty cycle of the signals. The opening frequency of solenoid valve 27 is related to the speed of pump 7, but is always below the maximum intake frequency of pump 7.

Solenoid valve 27 has a relatively small effective flow section, so that the fuel is metered before it is brought to high pressure by pump 7. Preferably, the flow section is such that, with control by a maximum-frequency or maximum-duty-cycle control signal, the maximum instantaneous flow of solenoid valve 27 is less than the maximum instantaneous flow that can be drawn by intake valve 25. The maximum instantaneous flow of solenoid valve 27 may be as much as 20% less than that of intake valve 25.

Advantageously, the flow section of solenoid valve 27 is also such as to produce, over a predetermined time interval T, a mean flow greater than the mean fuel flow drawn by suction valve 25. In FIG. 2, time interval T is indicated by two dot-and-dash lines, and is a multiple of the time unit defined above. Obviously, the number of signals A and C shown within time interval T in FIG. 2 is purely indicative. Time interval T may be of the same order of magnitude of the duration of the intake stroke of pumping element 18. Tests show that regulating the delivery of pump 7 only provides for accurately metering the fuel pumped upon operation of each injector 5 only by means of controlled modulation of the opening of solenoid valve 27 by control unit 16. As such, the storage volume of pressurized-fuel common rail 6 may be enormously reduced.

In the FIG. 1 embodiment, since the two pumping elements 18 are operated in phase opposition, the fuel pumped to pump 7 along intake conduit 10 is only drawn by the pumping element 18 performing the intake stroke at the time, while the intake valve 25 of the other pumping element 18 performing the compression stroke is closed (except for a few degrees at the start of the compression stroke).

Figure 3:
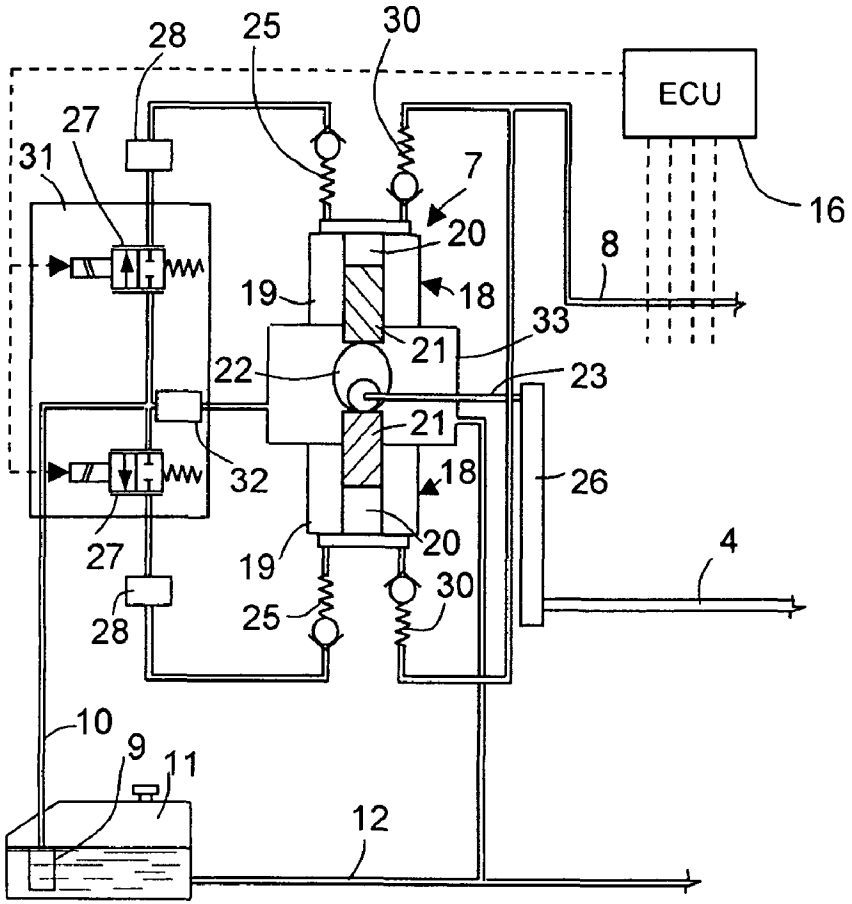

In the FIG. 3 variation, each pumping element 18 is associated with a corresponding on-off solenoid valve 27 and a corresponding intake fuel storage volume 28, and a pressure regulator 32 common to both on-off valves 27 feeds surplus fuel, for lubrication, into case 33, from where it is drained along drain conduit 12.

Figure 4:
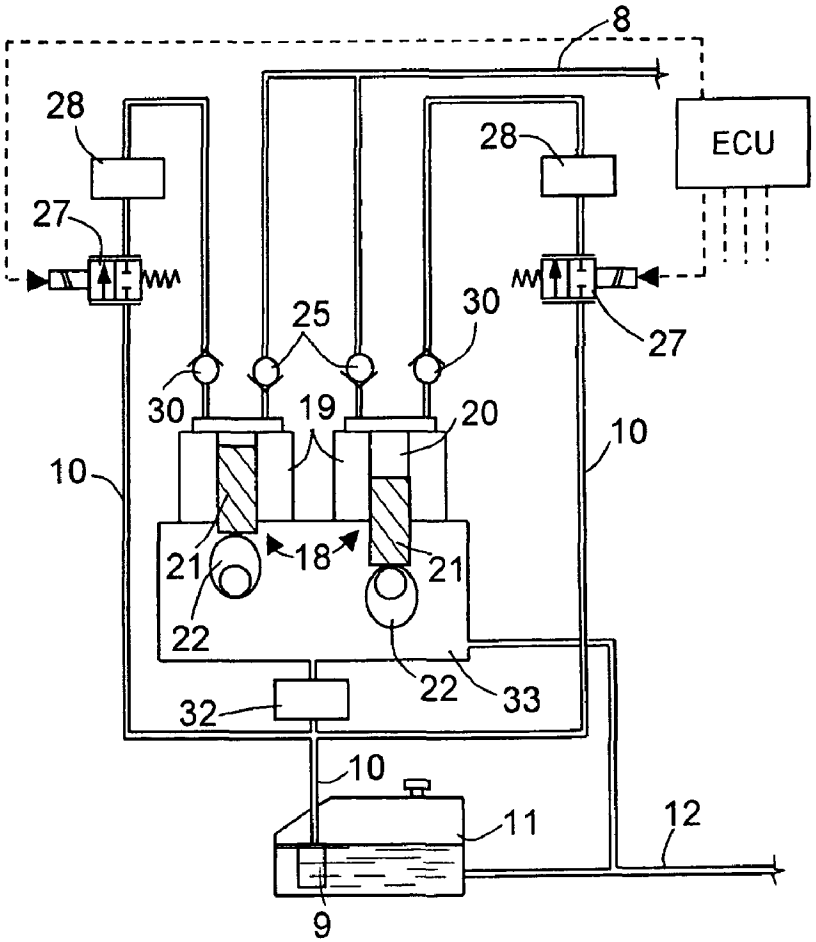
FIGS. 3 and 4 show two partial diagrams of two variations of the FIG. 1 system.

In the FIG. 4 variation, the two pumping elements 18 are located side by side and operated by two cams 22 fitted to shaft 23 with a phase displacement of 180°. In this case too, a corresponding on-off solenoid valve 27 and a corresponding intake fuel storage volume 28 are located upstream from each intake valve 25, and a common pressure regulator 32 regulates the pressure of the fuel in both on-off solenoid valves 27. Using two solenoid valves 27, one for each pumping element 18, provides for more accurate regulation. The FIG. 4 variation may obviously comprise only one on-off solenoid valve 27 located along a portion of intake conduit 10 common to both pumping elements 18.

The advantages, as compared with known technology, of the injection system comprising a device for regulating fuel delivery of high-pressure pump 7 according to the invention will be clear from the foregoing description. In particular, fuel may advantageously be metered at low pressure by solenoid valve 27, as opposed to pumping elements 18; asynchronous control of solenoid valve 27 eliminates the need to know the position of piston 21 to control metering of the fuel; solenoid valve 27 is controlled at a frequency independent of the intake frequency of pump 7; and, finally, being an on-off type, solenoid valve 27 is simpler than the proportional types used in known systems, so that the system according to the invention is extremely low-cost.

Clearly, changes and improvements may be made to the injection system comprising the high-pressure pump and regulating device described above, without, however, departing from the scope of the accompanying claims. For example, transmission device 26 may be eliminated, and shaft 23 of high-pressure pump 7 operated at a speed independent of that of drive shaft 4; solenoid valve 15 for draining fuel from common rail 6 may also be eliminated; and pump 7 may comprise a different number of pumping elements 18, e.g. three pumping elements operated with a phase displacement of 120° by a common cam.

Finally, solenoid valve 27 may be defined by a petrol or gas engine injector, i.e. a reliable, low-cost, commonly marketed component, to also act as a safety valve. Petrol engine injectors, in fact, have outlet orifices of different diameters, and are therefore easily adaptable to different-power engines.

The invention claimed is:

1. A fuel injection system of an internal combustion engine, comprising:

a variable-delivery high-pressure pump having at least one pumping element operating reciprocatingly to perform an intake stroke and a delivery stroke, said at least one pumping element having an intake valve communicating with an intake conduit, and a delivery valve communicating with a delivery conduit;

a regulating device located along said intake conduit for regulating the delivery of said pump, said regulating device comprising an on-off solenoid valve for defining the quantity of fuel supplied to said at least one pumping element, and a pressure regulator for maintaining a predetermined constant fuel pressure upstream from the on-off solenoid valve; and a control unit for controlling said on-off solenoid valve as a function of the operating conditions of the engine, wherein said control unit controls said on-off solenoid valve asynchronously with respect to said intake stroke by at least frequency-modulated control signals (A), wherein a maximum instantaneous flow of said on-off solenoid valve is as much as 20% less than the maximum instantaneous flow drawn by said intake valve, and wherein an intake fuel storage volume is located between said on-off solenoid valve and said intake valve to supply each pumping element over variable portions of the relative intake stroke, said high-pressure storage volume being also provided with a solenoid drain valve, said control unit also controlling opening and closing of said solenoid drain valve, and wherein the mean flow of said on-off solenoid valve is greater than the mean flow drawn by said intake valve.

2. The injection system as claimed in claim 1, wherein said on-off solenoid valve is an electric petrol or gas injector.

3. The injection system as claimed in claim 1, wherein said pump comprises a case which houses pump operating mechanisms, and wherein said pressure regulator maintains the pressure upstream from said on-off solenoid valves constant by feeding surplus fuel from a tank into said case to cool and lubricate said mechanisms, the surplus fuel then being drained from said case into said tank.

4. The injection system as claimed in claim 1, wherein said control unit controls said on-off solenoid valve as a function of the fuel pressure detected in a high-pressure storage volume by a corresponding pressure sensor.

5. The injection system as claimed in claim 1, wherein said control unit controls said on-off solenoid valve by control signals (A) of constant duration, said control signals (A) being emitted at variable frequency.

6. The injection system as claimed in claim 1, wherein said control unit controls said on-off solenoid valve by at least one of (1) control signals of a frequency related to the speed of said pump and (2) with a variable duty cycle.

7. The injection system as claimed in claim 6, wherein the frequency is less than the maximum intake frequency of said pump.

8. The injection system as claimed in claim 1, wherein the duration of each control signal (A, C) is in the order of a thousandth of a second, and/or said duty cycle ranges between 2% and 95%.

9. The injection system as claimed in claim 1, further comprising at least two pumping elements having corresponding intake valves communicating with a common intake conduit, wherein said regulating device is located along said common intake conduit.

10. In a fuel injection system for an internal combustion engine, the fuel injection system having an intake conduit for taking fuel into said fuel injection system and a delivery conduit for delivering the fuel from said fuel injection system to said internal combustion engine, the improvements comprising:

a variable-delivery high-pressure pump for the fuel taking in and delivery and having at least one pumping element for reciprocating to perform an intake stroke and a delivery stroke, an intake valve communicating said at least one pumping element with said intake conduit, and a delivery valve communicating said at least one pumping element with said delivery conduit;

a regulating device located along said intake conduit for regulating the taking in of the fuel, said regulating device comprising an on-off solenoid valve for defining a quantity of the fuel taken in, and a pressure regulator for maintaining a predetermined constant pressure of the fuel taken in from said on-off solenoid valve to said intake valve; and a control unit for controlling said on-off solenoid valve as a function of at least one operating condition of said internal combustion engine, wherein said control unit controls said on-off solenoid valve asynchronously with respect to said intake stroke from at least duty-cycle-modulated control signals (C), a maximum instantaneous flow of said on-off solenoid valve being as much as 20% less than the maximum instantaneous flow drawn by said intake valve, an intake fuel storage volume located between said on-off solenoid valve and said intake valve to supply said at least one pumping element over variable portions of the relative intake stroke, said high-pressure storage volume being also provided with a solenoid drain valve, said control unit also controlling opening and closing of said solenoid drain valve, and wherein the mean flow of said on-off solenoid valve is greater than the mean flow drawn by said intake valve.

* * * * *